US011434645B2

(12) United States Patent
Mast

(10) Patent No.: US 11,434,645 B2
(45) Date of Patent: Sep. 6, 2022

(54) METHOD AND ASSEMBLY FOR HANGING DECORATIVE STONE

(71) Applicant: Rock Decor Company, Apple Creek, OH (US)

(72) Inventor: Ricky D. Mast, Apple Creek, OH (US)

(73) Assignee: ROCK DECOR COMPANY, Apple Creek, OH (US)

( * ) Notice: Subject to any disclaimer, the term of this patent is extended or adjusted under 35 U.S.C. 154(b) by 0 days.

(21) Appl. No.: 17/078,316

(22) Filed: Oct. 23, 2020

(65) Prior Publication Data

US 2022/0127863 A1 Apr. 28, 2022

(51) Int. Cl.
*E04F 13/14* (2006.01)
*E04F 13/08* (2006.01)

(52) U.S. Cl.
CPC ..... *E04F 13/144* (2013.01); *E04F 13/0835* (2013.01)

(58) Field of Classification Search
CPC ..... E04F 13/14; E04F 13/141; E04F 13/142; E04F 13/144; E04F 13/145; E04F 13/147; E04F 13/148
USPC ..... 52/747.11, 747.12
See application file for complete search history.

(56) References Cited

U.S. PATENT DOCUMENTS 4,987,712 A * 1/1991 Mancuso ..... E04F 13/0862 52/387
6,315,489 B1 * 11/2001 Watanabe ..... E04F 13/0846 403/381
7,617,646 B2 * 11/2009 Losse ..... E04F 13/14 52/385
D643,133 S 8/2011 Steffes
3,042,309 A1 10/2011 Wolf
8,042,310 B2 * 10/2011 Hikai ..... B44C 1/28 52/489.2
8,141,310 B2 * 3/2012 Trezza ..... E04C 2/38 52/302.3
8,782,988 B2 7/2014 Wolf et al.
D713,552 S 9/2014 Steffes
D713,974 S 9/2014 Steffes
8,997,423 B2 4/2015 Mann
D742,034 S 10/2015 Steffes
D742,035 S 10/2015 Steffes
9,169,652 B2 10/2015 Steffes
9,869,098 B2 1/2018 Steffes
D809,671 S 2/2018 Steffes
9,903,124 B2 2/2018 Wolf et al.
10,329,775 B2 6/2019 Wolf et al.
D857,922 S 8/2019 Steffes
10,378,216 B2 8/2019 Wolf et al.
10,557,273 B2 2/2020 Wolf et al.
10,682,787 B2 6/2020 Steffes
10,895,077 B2 1/2021 Smith
D910,207 S 2/2021 Steffes
(Continued)

*Primary Examiner* — William V Gilbert
(74) *Attorney, Agent, or Firm* — Sand, Sebolt & Wernow Co., LPA

(57) ABSTRACT

The present disclosure relates to a method and assembly for hanging decorative stone. A method and assembly to hang decorative stone or other similarly situated devices with an integrally formed frame portion is discussed herein. An integrally formed frame portion with at least one first flange, at least one second flange that interface with a prior installed assembly of the same type without interacting with the stone portion.

16 Claims, 8 Drawing Sheets

(56) References Cited

U.S. PATENT DOCUMENTS

| | | | | |
|---|---|---|---|---|
| 11,047,134 | B2 | 6/2021 | Steffes | |
| 2008/0155922 | A1 | 7/2008 | Wolf | |
| 2009/0193742 | A1 | 8/2009 | Wolf | |
| 2011/0175255 | A1 | 7/2011 | Wernette | |
| 2011/0239578 | A1 | 10/2011 | Wolf | |
| 2012/0117904 | A1* | 5/2012 | Bouchard | E04F 13/0862 52/309.4 |
| 2012/0241574 | A1* | 9/2012 | Uota | E04F 13/0846 248/231.81 |
| 2014/0109504 | A1 | 4/2014 | Steffes | |
| 2014/0182225 | A1 | 7/2014 | Wilkie | |
| 2015/0021822 | A1 | 1/2015 | Wolf | |
| 2015/0191911 | A1 | 7/2015 | Mann | |
| 2016/0010342 | A1 | 1/2016 | Steffes | |
| 2016/0040437 | A1 | 2/2016 | Wolf | |
| 2020/0026343 | A9 | 8/2020 | Crosier et al. | |

* cited by examiner

METHOD AND ASSEMBLY FOR HANGING DECORATIVE STONE

BACKGROUND

Technical Field

The present disclosure relates generally to a method and apparatus for hanging decorative stone. More particularly, the present disclosure relates to a method and apparatus to hang decorative stone or other similarly situated devices with an integrally formed frame portion. Specifically, the present disclosure relates to a method and apparatus to hang decorative stone or other similarly situated devices with an integrally formed frame portion with at least one first flange, at least one second flange that interface with a prior installed assembly of the same type.

Background Information

When constructing a building, interior and exterior walls made of stone, rock, brick, or concrete can be costly and unwieldy. Further, it is extremely labor intensive. One or more of these individuals must use methods to hold and align the heavy material while attaching them to the wall.

Recently, premade or prefabricated products have been gaining in popularity. Their relative uniformity along with modular nature have become easier to install and mass produce. Many of these units are still unwieldy and require large amounts of preparation and effort to install properly. Whether it be precise measurements, small margins of error, or high degrees of training needed on the product, all lead to installation difficulty.

SUMMARY

Therefore, there exists a need for an assembly and method of installation that is easy to maneuver and install.

In one aspect, an exemplary embodiment of the present disclosure may provide a wall treatment comprising: a body; a first flange formed on the body defining a receiving area; an orienting flange formed on the body; and a cast portion extending adjacent to at least a portion of the body. This embodiment or another embodiment may provide the cast portion extends around at least a portion of the body. This embodiment or another embodiment may provide the first flange extends upwardly. This embodiment or another embodiment may provide the receiving area is positioned between the body and the first flange. This embodiment or another embodiment may provide a first angle defined by the first flange and the body, wherein the first angle is between about 20 and about 40 degrees. This embodiment or another embodiment may provide wherein the orienting flange extends downwardly. This embodiment or another embodiment may provide a second angle defined by the orienting flange and the body, wherein the second angle is between about 30 and about 60 degrees in an uninstalled position of the wall treatment. This embodiment or another embodiment may provide the second angle is between 10 and 30 degrees in an installed position of the wall treatment. This embodiment or another embodiment may provide an exposed portion extending beyond the cast portion. This embodiment or another embodiment may provide a third angle defined by the exposed portion and the body, wherein the third angle is between about 10 and about 35 degrees.

In another aspect, an exemplary embodiment of the present disclosure may provide a method for installing decorative stone comprising: affixing a body of a first wall treatment assembly at least one fastener to a wall; and aligning an exposed portion of a second wall treatment assembly with at least one first flange located on a body of the first assembly. This embodiment or another embodiment may provide orienting the first assembly relative to the second assembly. This embodiment or another embodiment may provide simultaneously to orienting: abutting at least one orienting flange on the first assembly with the body of the second assembly. This embodiment or another embodiment may provide fitting the at least one orienting flange on the first assembly into a receiving area on the body of the second assembly. This embodiment or another embodiment may provide supporting the at least one orienting flange on the first assembly within the receiving area of the second assembly. This embodiment or another embodiment may provide changing an angle of the at least one orienting flange from a first angle to a second angle as a result of the contact with the body of the second apparatus. This embodiment or another embodiment may provide setting a space between the first assembly and the second assembly as a result of alignment. This embodiment or another embodiment may provide there is no contact between a top side of a cast portion of the first assembly and a bottom side of a cast portion of the second assembly. This embodiment or another embodiment may provide installing a plurality of assemblies in a parallel manner in both a vertical and horizontal direction. This embodiment or another embodiment may provide avoiding contact of an outer region of the first assembly and with an outer region of the second assembly.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

A new assembly or wall treatment 10 and method of installation is depicted in the present disclosure and throughout FIGS. 1-6B. Assembly 10 is a new and improved assembly for hanging decorative stone, as will be discussed hereafter within the present disclosure.

Figure 1:
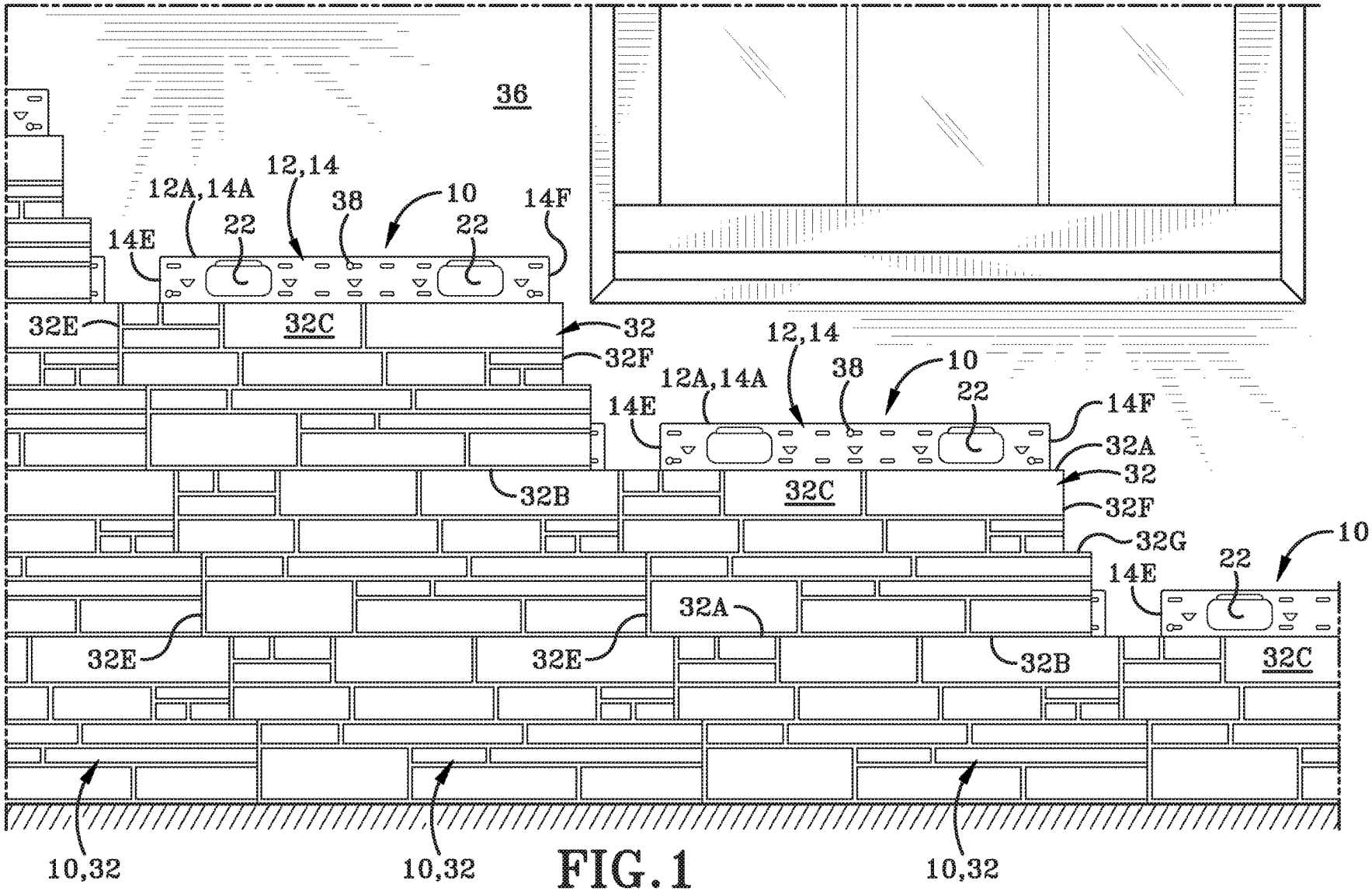
FIG. 1 is a front view of multiple exemplary assemblies installed and being installed on a wall.

FIG. 1 shows a front view of multiple exemplary assemblies 10 installed and being installed on a wall. The assemblies 10 have been secured to the wall and stacked on top of one another in a precise way as will be discussed herein.

Figure 2:
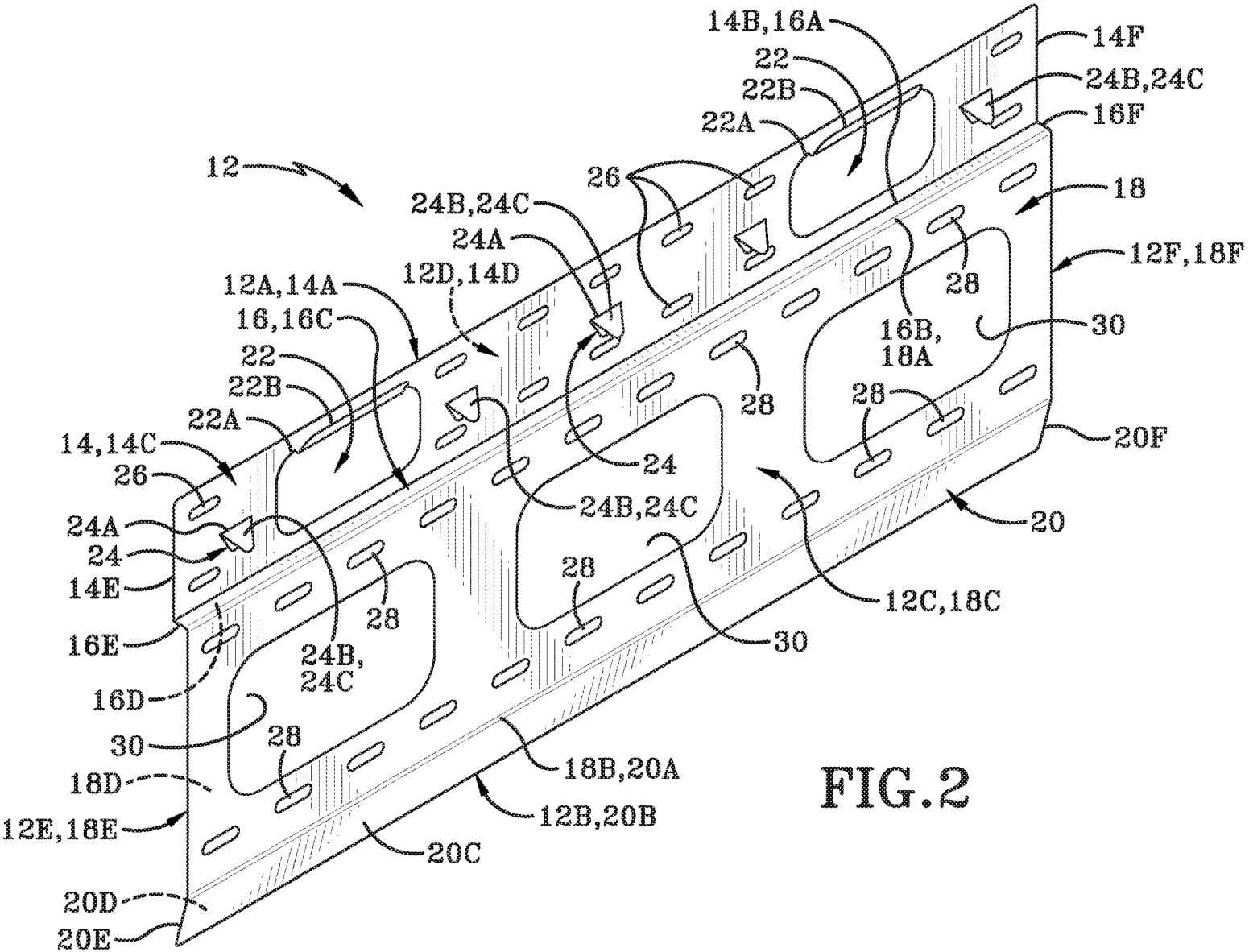
FIG. 2 is a top front left side view of an exemplary frame portion of an assembly.

Referring specifically to FIG. 2, a top front left side view of an exemplary first portion or frame portion 12 of an assembly 10 is shown. In this view, the frame portion 12 includes a top side 12A, a bottom side 12B longitudinally opposed from the top side 12A, a front side 12C, a rear side 12D opposed the front side 12C, a first side 12E, and a second side 12F transversely opposed from the first side 12E. The frame portion 12 may be made of any desired material. Some example materials include but are not limited to: metals, including: steel, corrosion-resistant steel, aluminum, stainless steel, zinc, copper; polymeric materials composite materials; plastic materials; reinforced plastics; thermoplastics; fiber composites; reinforced wood; and combinations thereof.

The frame portion 12 includes four specific regions, a first region 14, a second region 16, a third region 18, and a fourth region 20. The first region 14 includes a top side 14A which is also commensurate with the top side 12A of the frame portion 12, a bottom side 14B longitudinally opposed rom the top side 14A. The first region 14 further includes a front side 14C commensurate with a portion of the top side 12C of the frame portion 12, a rear side 14D commensurate with a portion of the rear side 12D of the frame portion 12 where the rear side 14D is opposed the front side 14C. Additionally, the first region 14 includes a first side 14E commensurate with a portion of the first side 12E of the frame portion 12, and a second side 14F commensurate with a portion of the second side 12F of the frame portion 12 and wherein the first side 14F transversely opposed from the first side 14E.

The first region 14 further includes a first aperture 22, a second aperture 24 and fastener apertures 26. The first aperture 22 is generally oval in nature and on its top side 22A includes a first flange 22B. The first flange 22B extends away from the front side 12C of the frame portion 12 towards the top side 12A at an acute angle, as will be discussed later with respect to FIG. 5A. In the exemplary embodiment there are shown to be two first apertures 22 and two first flanges 22B for the purposes of illustration. In alternative embodiments, there could be no first apertures 22 but still first flanges 22B. In further alternative embodiments, there could be infinite numbers of individually defined first apertures or infinitely defined first flanges based on the desired implementation.

The second aperture 24 is generally triangular in nature and on its top side 24A includes a second flange or orienting flange 24B. The second flange 24B extends away from the front side 12C of the frame portion 12 towards the bottom side 12B at an acute angle, as will be discussed later with respect to FIG. 5A. In the exemplary embodiment there are shown to be five second apertures 24 and five second flanges 24B for the purposes of illustration. In alternative embodiments, there could be no second apertures 24 but still second flanges 24B. In further alternative embodiments, there could be infinite numbers of individually defined second apertures or infinitely defined second flanges based on the desired implementation.

Both the first flanges 22B and second flanges 24B can be made of a multitude of materials. As will become clear with respect to the operation, the second flanges should be made of a resilient but deformable material. The materials may include, but are not limited to: metals, including: steel, corrosion-resistant steel, aluminum, stainless steel, zinc, copper; polymeric materials composite materials; plastic materials; reinforced plastics; thermoplastics; fiber composites; reinforced wood; and combinations thereof.

The fastener apertures 26 are generally oval in nature and eliminate any material between the top side 12C and rear side 12D in a transverse manner. The apertures are operative to accept a body of a fastener (not shown) while retaining the head of the fastener (not shown) as will be discussed with respect to operation.

The second region 16 includes a top side 16A which is also commensurate with the bottom side 14B of the first portion 14, a bottom side 16B longitudinally opposed from top side 16A. The second region 16 further includes a front side 16C commensurate with a portion of the top side 12C of the frame portion 12, a rear side 14D commensurate with a portion of the rear side 12D of the frame portion 12 where the rear side 14D is opposed the front side 14C. Additionally, the second region 16 includes a first side 16E commensurate with a portion of the first side 12E of the frame portion, and a second side 16F commensurate with a portion of the second side 12F of the frame portion and wherein the first side 16F transversely opposed from the first side 16E. The second region 16 is generally disposed perpendicular to the first region 14.

The third region 18 includes a top side 18A which is also commensurate with the bottom side 16B of the second portion 16, a bottom side 18B longitudinally opposed from the top side 18A. The third region 18 further includes a front side 18C commensurate with a portion of the top side 12C of the frame portion 12, a rear side 18D commensurate with a portion of the rear side 12D of the frame portion 12 where the rear side 18D is opposed the front side 18C. Additionally, the third region 18 includes a first side 18E commensurate with a portion of the first side 12E of the frame portion, and a second side 18F commensurate with a portion of the second side 12F of the frame portion and wherein the first side 18F transversely opposed from the first side 18E. The third region 18 is generally perpendicular to the second region 16 while generally parallel to the first region 14.

The third region 18 is generally perpendicular to the second region 16 while generally parallel to the first region 14.

The third region 18 further includes third apertures 28 and fourth apertures 30. The third apertures 28 are generally oval in nature and are shaped identical to the fastener apertures in the exemplary embodiment. In the exemplary embodiment there are shown to be a plurality of third apertures for the purposes of illustration. In alternative embodiments, there could be no third apertures 28. In further alternative embodiments, there could be infinite numbers of individually defined third apertures 28 based on the desired implementation.

The fourth apertures 30 are generally oval in nature in the exemplary embodiment. In the exemplary embodiment there are shown to be three fourth apertures 30 for the purposes of illustration. In alternative embodiments, there could be no fourth apertures 30. In further alternative embodiments, there could be infinite numbers of individually defined fourth apertures 30 based on the desired implementation. However, there must be some form of aperture present in the third region 18 for certain desired implementations as will be discussed with respect to FIG. 3 and FIG. 4

The fourth region 20 includes a top side 20A which is also commensurate with the bottom side 18B of the third portion 18, a bottom side 20B which is also commensurate with the bottom side 12B of the frame portion 20 which is longitudinally opposed rom the top side 20A. The fourth region 20 further includes a front side 20C commensurate with a portion of the top side 12C of the frame portion 12, a rear side 20D commensurate with a portion of the rear side 12D of the frame portion 12 where the rear side 20D is opposed the front side 20C. Additionally, the fourth region 20 includes a first side 20E commensurate with a portion of the first side 12E of the frame portion, and a second side 20F commensurate with a portion of the second side 12F of the frame portion and wherein the first side 20F transversely opposed from the first side 18E. The fourth region 20 angled toward the rear side 20D and away from the front 18C of the third portion.

Figure 3:
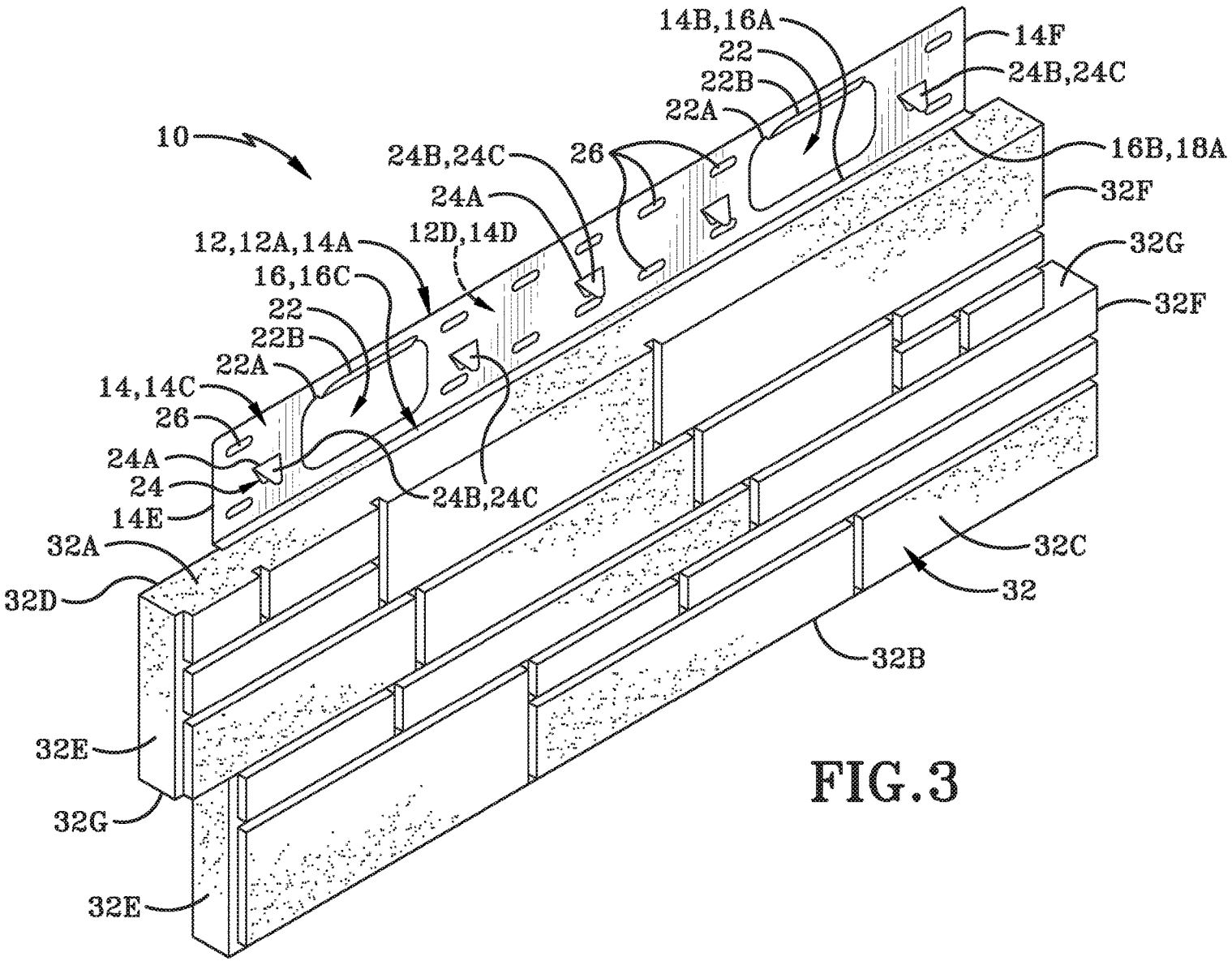
FIG. 3 is a top front left side view of the single exemplary assembly.
Figure 4:
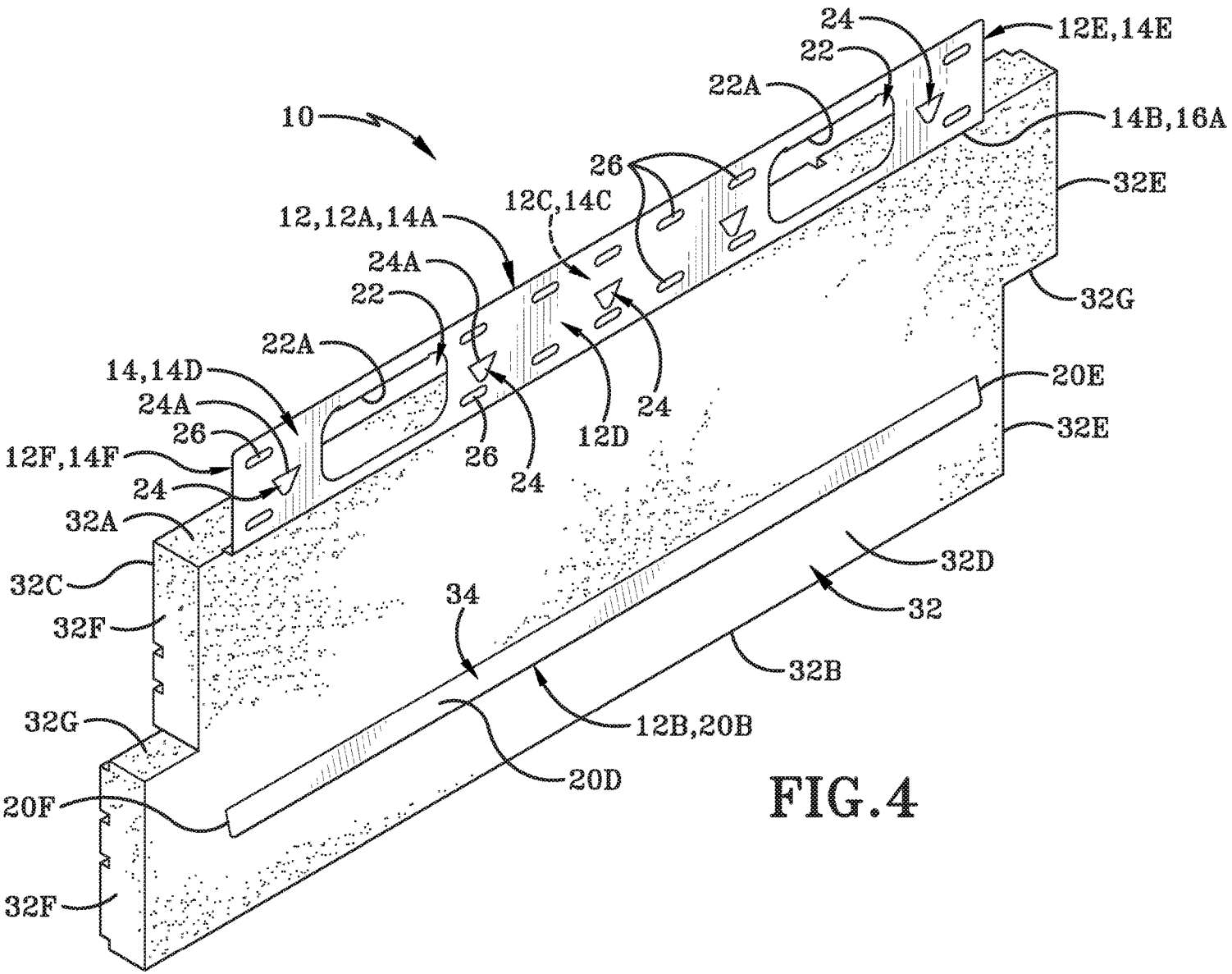
FIG. 4 is a top back right side view of the exemplary assembly.

Referring now to FIG. 3 and FIG. 4, views of the constructed assembly 10 is shown. Within this view, the second portion or outer region 32 is shown. The outer region 32 includes a top side 32A, a bottom side 32B longitudinally opposed from the top side 32A, a front side 32C, a back side 32D opposed the front side 32C, a first side 32E, and a second side 32F transversely opposed from the first side 32E. The first side 32E and second side 32F further include a staggered portion 32G. The staggered portion 32G includes a recess on the first side 32E and a protrusion on the second side 32F. The purpose of the staggered portion 32G will be discussed with respect to operation. The outer region 32 covers the entirety of the third region 18 and a portion of the fourth region 20.

The outer region 32 is a construction material that surrounds at least a portion of the frame portion 12 so as to provide a decorative design and desired look for the assembly 10. In the exemplary embodiment, the outer region 32 may be made from a wide array of materials, including but not limited to: concrete, stamped concrete, mounted stone, stucco, plaster, tile, manufactured stone, natural stone veneers, brick, other masonry systems, foam materials, polymers, chopped fiber reinforced materials, and/or composite structures.

The outer region 32 may be placed around the frame portion 12 in multiple ways. The third apertures 28 and fourth apertures 30 are operative to accept flowable material while the frame portion 12 is within a mold. As such, material may freely flow between the front side 32C and rear side 32D within a mold (not shown) as a result of at least one of the third apertures 28 and fourth apertures 30. As such, the frame portion 12 about the third portion 18 is integrally formed within the outer region 32 and is not permitted to move once formed and installed correctly.

FIG. 4 (FIG. 4) is a top back right side view of the exemplary assembly 10 and shows an exposed portion 34. The exposed portion 34 is a portion of the fourth region 20, specifically the end proximate the second end 20B. The exposed portion 34 is at an angle with respect to the rear 32D.

Figure 5:
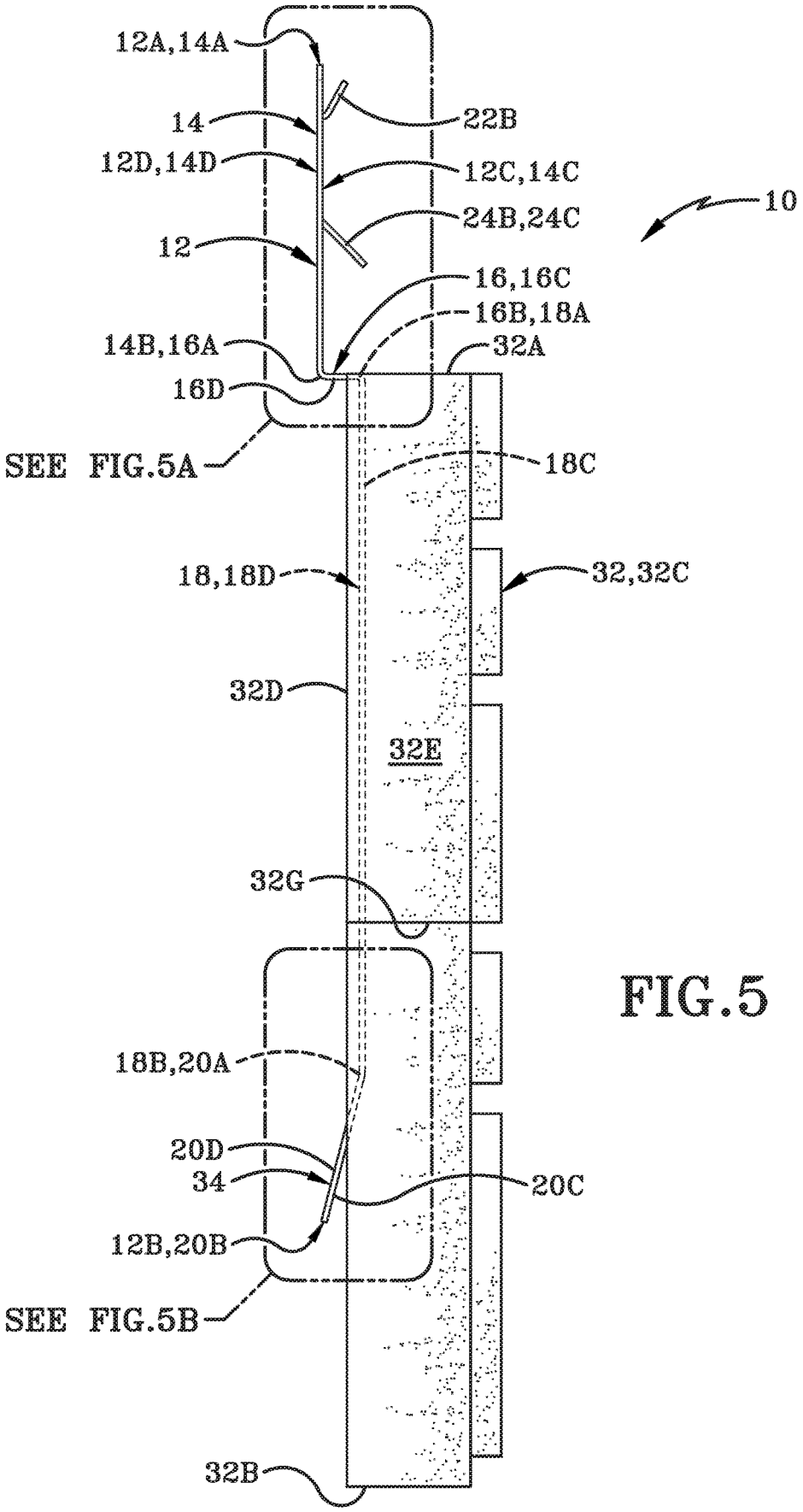
FIG. 5 is a left side view of the exemplary assembly
Figure 5A:
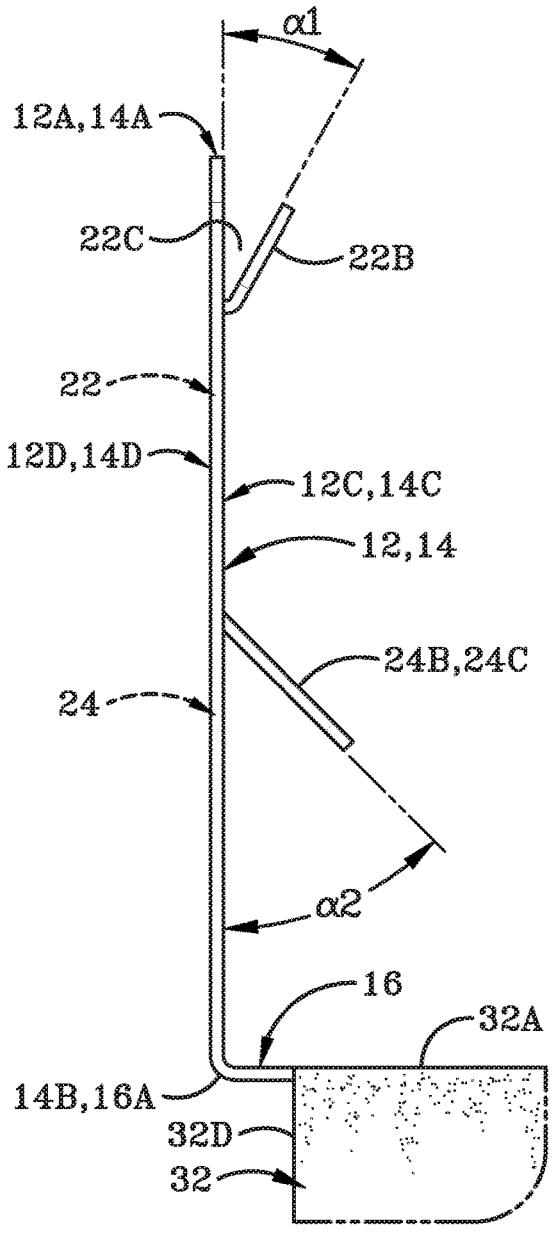
FIG. 5A is an enlarged left side view along the highlighted region FIG. 5A of FIG. 5.
Figure 5B:
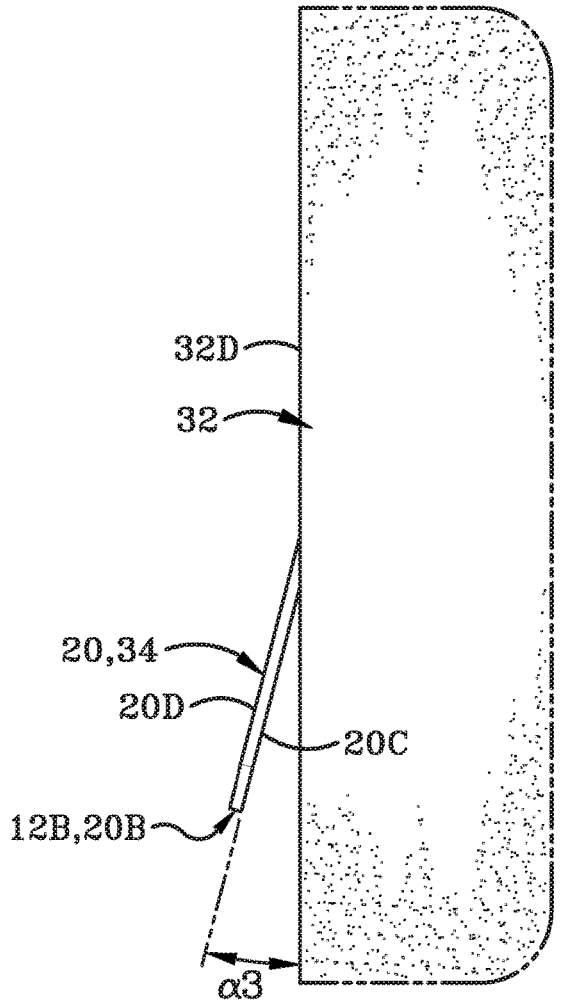
FIG. 5B is an enlarged left side view along the highlighted region FIG. 5B of FIG. 5.

Referring specifically to FIG. 5, FIG. 5A and FIG. 5B, side views of the assembly 10 are shown. FIG. 5A is an enlarged region along the area FIG. 5A in FIG. 5. In this figure, the angle $\alpha 1$ of the first flange 22B and the angle $\alpha 2$ of the second flange 24B are shown. In one embodiment, the angle $\alpha 1$ of the first flange 22B is between about 15 and about 45 degrees. In a further embodiment the angle $\alpha 1$ is about 25 to about 35 degrees. In the exemplary shown embodiment, the angle $\alpha 1$ is about 30 degrees. The angle $\alpha 1$ is relatively stiff and will not flex much or at all as will be discussed with respect to operation. Further within this figure, a receiving area 22C is defined by the interior of the first flange 22B disposed from the first portion 14A about the angle $\alpha 1$ The angle $\alpha 2$ of the second flange 24B is greater than that of angle $\alpha 1$. In one embodiment, the angle $\alpha 2$ of the second flange 24B is between about 30 and about 60 degrees. In a further embodiment, the angle $\alpha 2$ is about 40 to about 50 degrees. In the exemplary shown embodiment, the angle $\alpha 2$ is about 45 degrees. The angle $\alpha 2$ is relatively flexible and may flex under loads as will be discussed with respect to operation.

Referring specifically to FIG. 5B, an enlarged region along the area FIG. 5B in FIG. 5. In this figure, the angle $\alpha 3$ of the exposed portion 34 is shown. In one embodiment, the angle $\alpha 3$ of the exposed portion 34 is between about 5 and about 40 degrees. In a further embodiment the angle $\alpha 3$ is about 10 to about 35 degrees. In the exemplary shown embodiment, the angle $\alpha 3$ is about 15 degrees. The angle $\alpha 3$ is relatively stiff and will not flex much or at all as will be discussed with respect to operation. In the exemplary shown embodiment, the angle $\alpha 3$ less than the angle $\alpha 2$ and the angle $\alpha 1$.

Having thus described an exemplary non-limiting configuration of the assembly 10, its operation and method of installation will be discussed with reference to some exemplary features used with the various embodiments. For the sake of clarity, an initial installed assembly will be referred to as 10'. This initial installed assembly has the same features as the assembly 10.

Figure 6A:
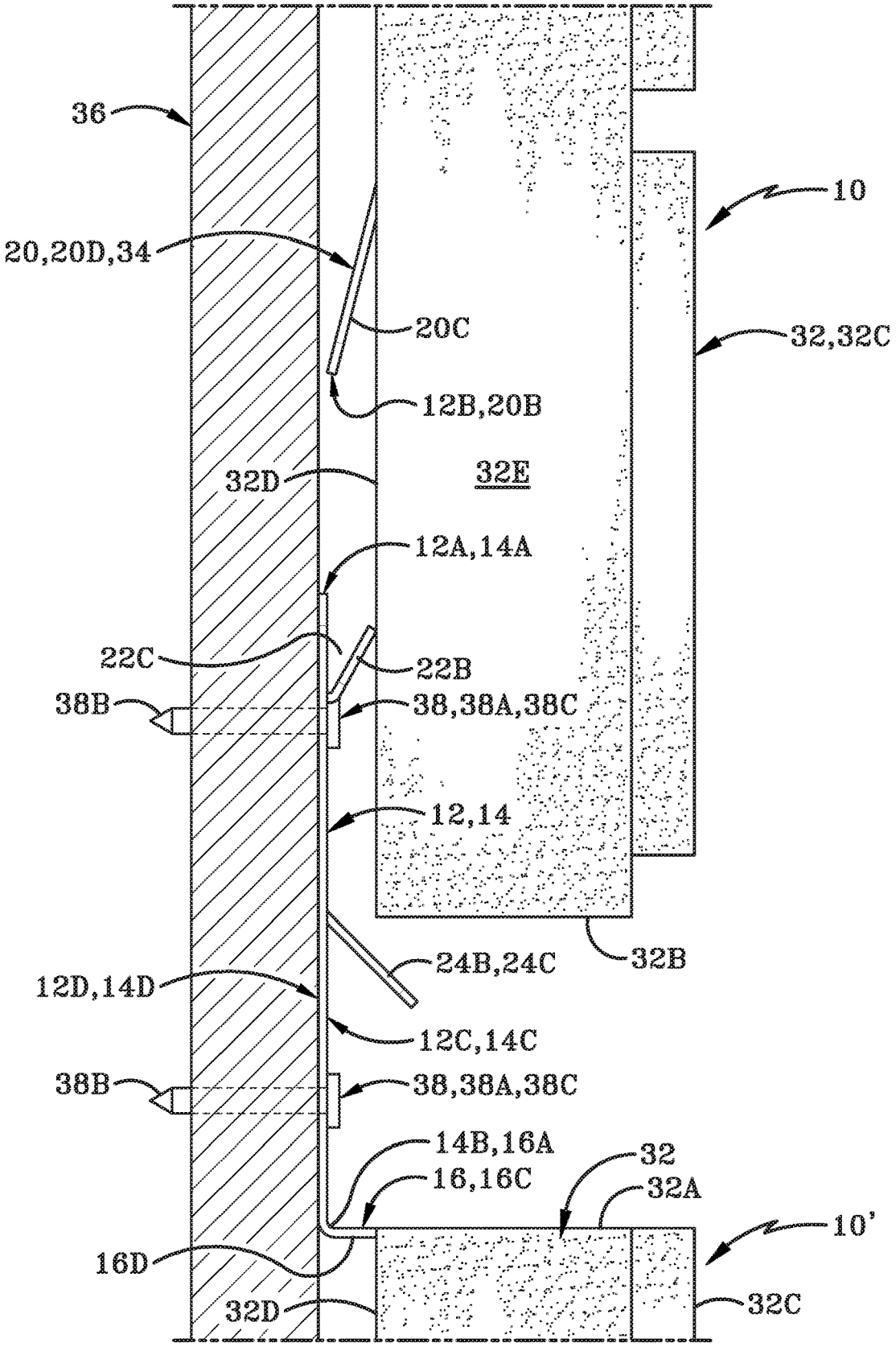
FIG. 6A is an operational view of the assembly being installed on a wall.

Referring specifically to FIG. 6A, an operational view installing a single assembly 10 is shown. First, the initial assembly 10' is installed or otherwise affixed on a wall 36 or other similarly situated barrier. This may be installed through use of a spacing device, board, or other similarly situated devices in order to be able to secure the first assembly 10' to the wall 36 through use of at least one fastener 38. The fasteners 38 have a first end 38A and a second end 38B transversely opposed thereto. The fasteners 38 further include a head 38C with a diameter greater than that of the fastener apertures 26. This diameter greater than that of the fastener apertures allows the head 38C of the fastener 38 to retain the frame portion 12 in contact with the wall 36. When the exposed portion 34 is installed as the first piece installed, it may flex slightly and decrease the angle $\alpha 3$ but allow a gap between the wall and the rear side 32B of the outer region 32 is equal to that of the second portion 16.

The assembly 10 is then aligned by a user lifting up the assembly 10 and aligning the exposed portion 34 with the first flange 22B. Ideally, the distance to the first flange 22B is offset by the same distance as the staggered portion 32G. This allows the assembly 10 to form a fully cohesive structure with no noticeable gaps between the individual pieces of assembly 10. As such, one may align the exposed portion 34 with the first flange 22B by abutting the first side 32E or second side 32F of the to be installed assembly 10 with its opposite side 32F or 32E of the installed assembly piece 10' and shifting over slightly when the first flange 22B of the installed assembly piece 10' makes contact with the exposed portion 34 of the to be installed piece 10 within the receiving portion 22C.

Figure 6B:
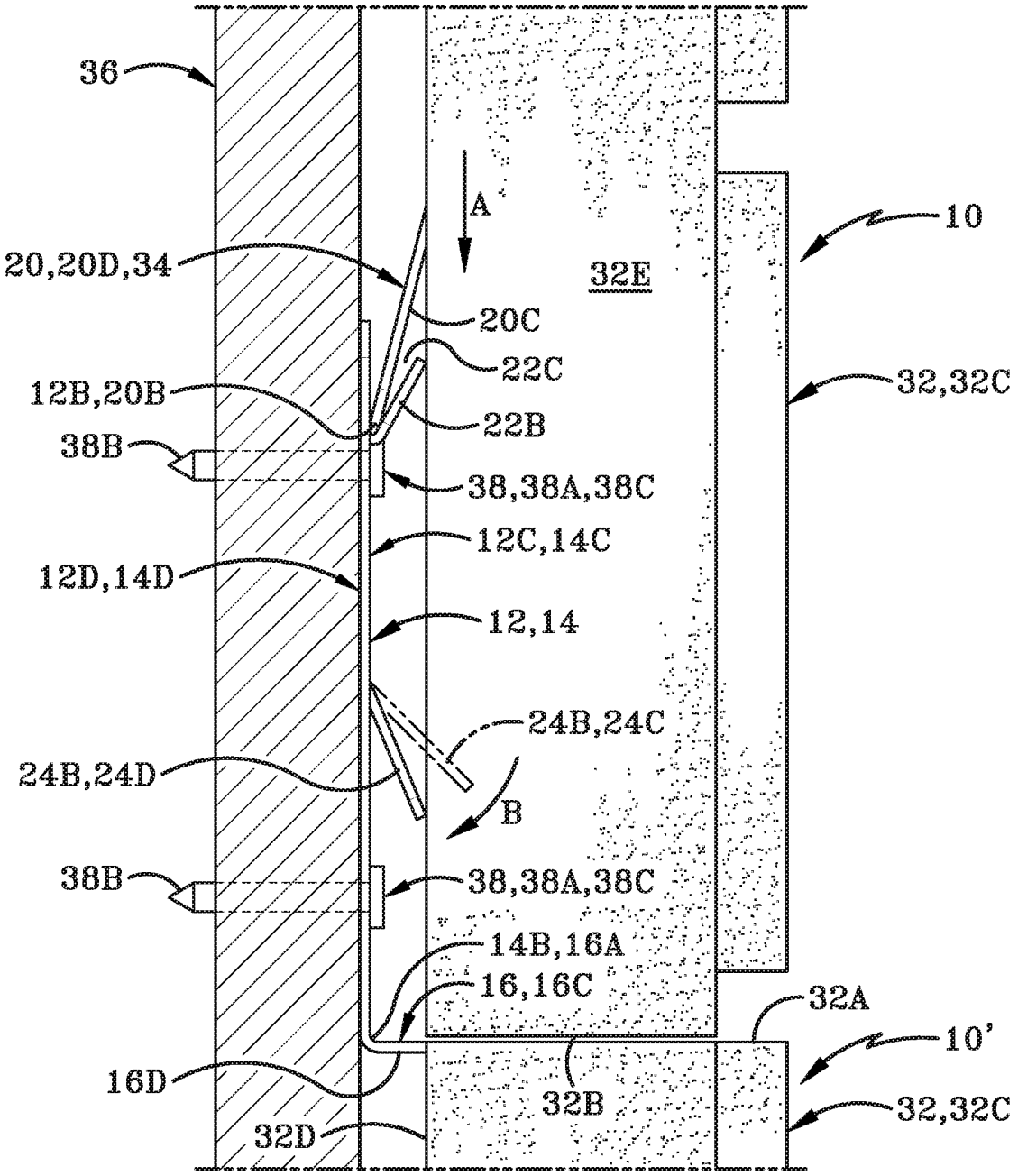
FIG. 6B is a further operational view of the assembly being installed on a wall.

Referring specifically to FIG. 6B, a continued operational view installing a series of assemblies 10 is shown. The assembly 10 is lowered along direction arrow "A", drawing the bottom 32B of the to be installed piece closer to the top 32A of the installed piece. The new assembly 10 covers the exposed frame portion 12 including the first region 14 and second region 16 of the installed assembly 10'.

As the assembly 10 is lowered along arrow "A", the rear 32D of the installing assembly 10 makes contact and abuts the second flange 24B of the installed assembly 10'. This contact with the rear 32D of the installing assembly 10 decreases by the second flange 24B flexing about the angle $\alpha 2$ from a first position or uninstalled position 24C to a second position or installed position 24D along arrow "B". Ideally, no direct contact is made by the bottom 32B of the outer region 32 of the to be installed assembly 10 with the top 32A of the outer region 32 of the installed piece 10'. Therefore, the angle $\alpha 2$ is at its least value. In one embodiment, the angle $\alpha 2$ of the second flange 24B at the second position 24D is between about 5 degrees and about 40 degrees. In a further embodiment the angle $\alpha 2$ is about 10 degrees to about 35 degrees. In the exemplary shown embodiment, the angle $\alpha 2$ is about 15 degrees. Simultaneous to the movement along arrow "B" the exposed portion 34 makes contact with the first flange 24B.

The second flange 24B is operative to resist movement along arrow "B" but allow installation. Simultaneously to this, the first flange 22B is operative to desire to open greater than its angle $\alpha 1$. However, the exposed portion 34 resists this motion in an opposite manner and allows the angle of both $\alpha 1$ and $\alpha 3$ to remain constant while $\alpha 2$ is equal or almost equal to $\alpha 3$. Thereby, these equal forces allow for alignment within the installed system as a whole. The initial installed assembly 10' and the assembly 10 once installed will not touch or rely on each other for support. The frame portion 12 through its engagement with the wall 36 and fasteners 38 allow for alignment without the outer regions 32 touching.

This process of installing one assembly 10 while using other assemblies as a guide is then repeated until the wall is covered to a user's desired amount. The process is best repeated in a parallel manner in both 90 degrees up or down as well as 90 degrees across. A plurality of assemblies may be installed in this manner to create a system of installed assemblies. Further, in an exemplary embodiment a system for assemblies may be built out to be virtually any shape or size that is desired by a consumer. The assembly 10 may have any desired designed pattern, and the shown pattern is merely one exemplary embodiment.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "element A and/or element B", when used in conjunction with open-ended language such as "comprising" can refer, in one embodiment, to element A only (optionally including elements other than element B); in another embodiment, to element B only (optionally including elements other than element A); in yet another embodiment, to both element A and element B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A method for installing decorative stone comprising:

providing a plurality of wall treatment assemblies, wherein each wall treatment assembly is fabricated to include a cast portion having a first surface that is decorative, an opposed second surface, and an upper end and a lower end extending between the first surface and the second surface; a frame portion having: a first region having a first end and a second end, the first region having a first flange and an orienting flange; a second region extending generally perpendicular from the second end of the first region, the second region having a first end connected to the second end of the first region and a second end; a third region extending generally perpendicular from the second end of the second region, the third region having a first end connected to the second end of the second region and a second end, the third region being within in the cast portion; and a fourth region, having a first end connected to the second end of the third region, the fourth region having a portion including the second end protruding from the second surface defining an exposed portion;

affixing the first region of a first wall treatment assembly of the plurality of wall treatment assembles with at least one fastener to a wall; and aligning the exposed portion of a second wall treatment assembly of the plurality of wall treatment assemblies with the first flange of the first wall treatment assembly;

receiving the exposed portion of the second wall treatment assembly into a receiving area defined by the first flange and the first region of the first wall treatment assembly; covering the first region of the first wall treatment assembly with the cast portion of the second wall treatment assembly; and securing the first region of the second wall treatment assembly to the wall with at least one fastener.

2. The method of claim 1, further comprising:

contacting the orienting flange of the first wall treatment assembly with the second surface of the cast portion of the second wall treatment assembly; and changing an angle of the orienting flange of the first wall treatment assembly from a first angle to a second angle as a result of the contact with the cast portion of the second wall treatment assembly.

3. The method of claim 1, further comprising:

setting a space between the first wall treatment assembly and the second wall treatment assembly as a result of the alignment of the exposed portion of the second wall treatment assembly with the first flange of the first wall treatment assembly.

4. The method of claim 1, positioning the lower end of the second wall treatment assembly a distance vertically above the upper end of the first wall treatment assembly such that there is no contact therebetween.

5. The method of claim 1, further comprising:

installing the plurality of wall treatment assemblies in a parallel manner in both a vertical and horizontal direction.

6. The method of claim 1, further comprising:

avoiding contact between the decorative first surface of the first wall treatment assembly and the decorative first surface of the second wall treatment assembly.

7. A wall treatment comprising:

a cast portion having a first surface that is decorative, an opposed second surface, and an upper end and a lower end extending between the first surface and the second surface;

a frame portion having:

a first region having a first end and a second end, the first region having a first flange and an orienting flange;

a second region extending generally perpendicular from the second end of the first region, the second region having a first end connected to the second end of the first region and a second end;

a third region extending generally perpendicular from the second end of the second region, the third region having a first end connected to the second end of the second region and a second end, the third region being within the cast portion; and a fourth region, having a first end connected to the second end of the third region, the fourth region having a portion including the second end protruding from the second surface defining an exposed portion.

8. The wall treatment of claim 7, further comprising a receiving area positioned between the first region of the body and the first flange.

9. The wall treatment of claim 7, further comprising: a first angle defined by the first flange and the first region of the body, wherein the first angle is between about 20 and about 40 degrees.

10. The wall treatment of claim 7, further comprising: a second angle defined by the orienting flange and the first region of the body, wherein the second angle is between about 30 and about 60 degrees in an uninstalled position of the wall treatment.

11. The wall treatment of claim 7, further comprising: a second angle defined by the orienting flange and the first region of the body, wherein the second angle is between 10 and 30 degrees when the wall treatment is in an installed position.

12. The wall treatment of claim 1, further comprising: a third angle defined by the exposed portion and the second surface, wherein the third angle is from about 150 degrees up to about 170 degrees.

13. The wall treatment of claim 7, wherein in an installed position the first flange is spaced a distance vertically above the orienting flange on the first region of the body, and the first flange and the orienting flange are spaced a distance laterally apart from one another on the first region.

14. The wall treatment of claim 7, wherein the first region of the body defines a plurality of apertures therein which are adapted to receive fasteners therethrough to secure the first region to a wall during installation of the wall treatment.

15. The wall treatment according to claim 7, wherein the second region is substantially flush with the upper end of the cast portion.

16. The wall treatment according to claim 7, wherein the first flange and the orienting flange angle outwardly away from the first surface of the first region, and the orienting flange is located between the first flange and the second region.

* * * * *